United States Patent [19]

Nishida et al.

[11] Patent Number: 4,557,698

[45] Date of Patent: Dec. 10, 1985

[54] APPARATUS FOR SUPPLYING CARDBOARDS

[75] Inventors: Hiroshi Nishida; Kouichi Hizawa; Taiichi Mine, all of Hiratsuka, Japan

[73] Assignee: The Japan Tobacco & Salt Public Corporation, Tokyo, Japan

[21] Appl. No.: 550,094

[22] Filed: Nov. 9, 1983

[30] Foreign Application Priority Data

Nov. 10, 1982 [JP] Japan ..... 57-196032

[51] Int. Cl.[4] ..... B65H 3/22; B65H 3/48

[52] U.S. Cl. ..... 414/330; 271/18.3; 271/34; 271/105; 271/149; 414/116

[58] Field of Search ..... 414/110, 116, 330; 271/10, 18.3, 34, 105, 116, 149, 150

[56] References Cited

U.S. PATENT DOCUMENTS

| | | | |
|---|---|---|---|
| 1,530,209 | 3/1925 | Scheuner | 271/10 X |
| 2,698,100 | 12/1954 | Fried | 414/110 X |
| 2,734,743 | 2/1956 | Spurlino et al. | 271/10 X |
| 2,954,227 | 9/1960 | Galloway | 271/34 |
| 3,159,396 | 12/1964 | Barber | 271/34 |
| 3,894,732 | 7/1975 | Muller | 271/34 X |

FOREIGN PATENT DOCUMENTS

| | | | |
|---|---|---|---|
| 767000 | 9/1980 | U.S.S.R. | 271/18.3 |

*Primary Examiner*—Leslie J. Paperner

[57] ABSTRACT

An apparatus for supplying cardboard is provided. The apparatus comprises a frame, a cardboard stack support means provided on said frame to detect a position of the front of the cardboard stack, cardboard stack support drive means, cardboard raising mechanisms mounted in said frame and capable of being in contact with the front of the cardboard stack at a reference position, a pair of feed rollers provided in said frame and above said cardboard stack raising mechanisms and compressed air jetting means facing the opposite sides of the laminar cardboard stack. The apparatus for supplying cardboards, which has the means described above, can readily and reliably supply laminar pulp cardboards one by one.

13 Claims, 4 Drawing Figures

APPARATUS FOR SUPPLYING CARDBOARDS

BACKGROUND OF THE INVENTION

This invention relates to an apparatus for supplying laminar pulp cardboards (hereinafter referred to as cardboards).

In a prior art apparatus for supplying laminar pulp cardboards, pulp cardboards are stacked on a cardboard stack support manually one after another, and they are supplied one by one by means of a suction board. However, the operation of manually stacking pulp cardboards one by one requires a great deal of time for cardboards in a stack, which are rendered into close contact with one another and with more or less adhering force while they are transported or stored. Besides, there is a possibilitiy that a plurality of cardboards are simultaneously supplied due to failure of separation.

SUMMARY OF THE INVENTION

The invention seeks to obviate the above drawbacks in the prior art, and its object is to provide an apparatus for supplying cardboards, which can readily and reliably supply cardboards one by one.

DETAILED DESCRIPTION OF THE EMBODIMENTS

An embodiment of the invention will now be described with reference to the accompanying drawings.

Figure 1:
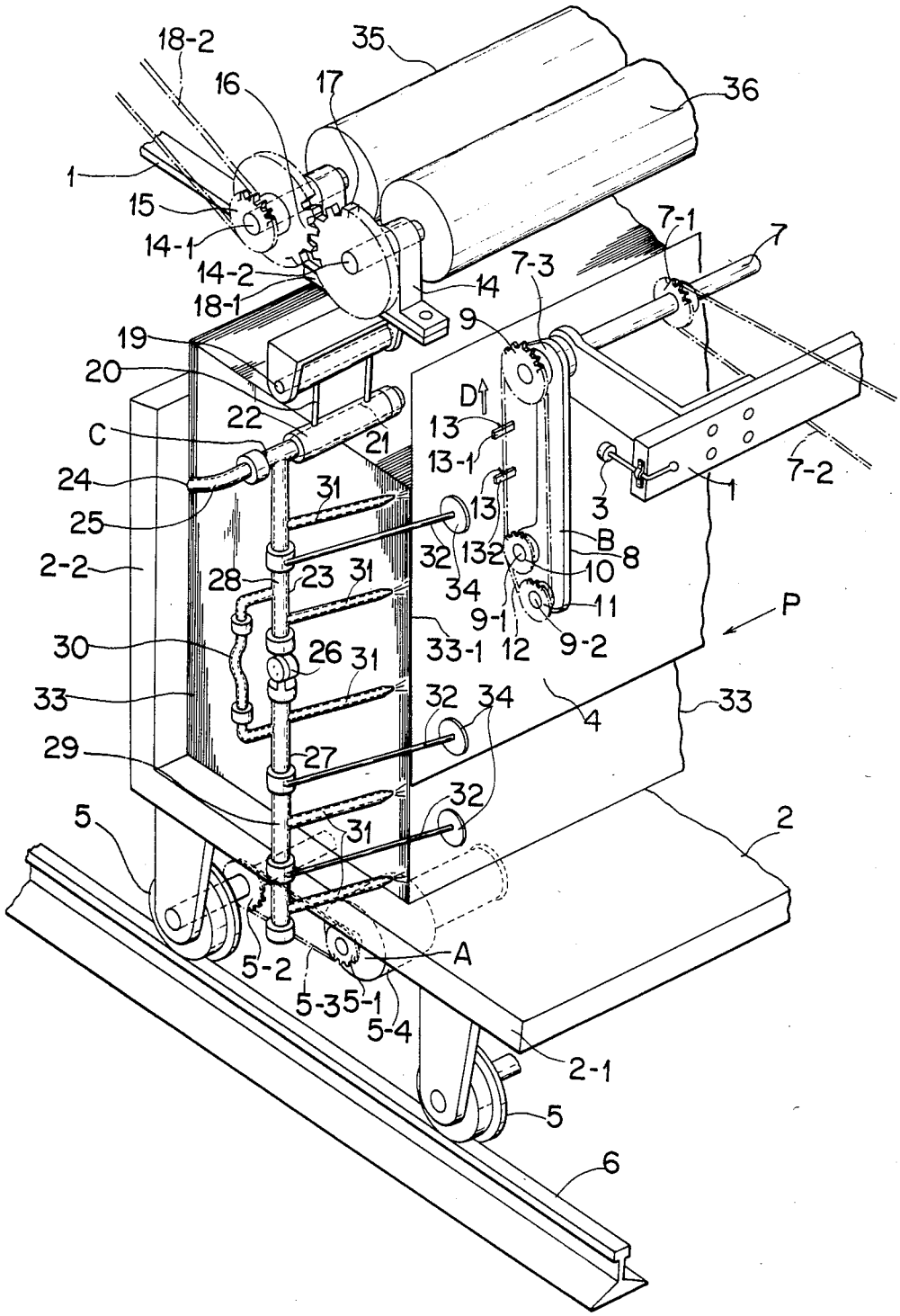
FIG. 1 is a perspective view showing an embodiment of the invention (half portion of the apparatus)
Figure 2:
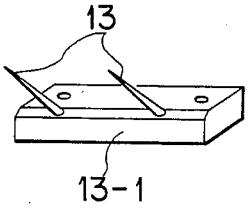
FIGS. 2 to 4 are perspective views showing respective examples of hook supports.

Referring to FIGS. 1 and 2, there is shown an apparatus for supplying pulp cardboards according to the invention. The apparatus comprises a cardboard stack support 2, a cardboard front position detector 3, a cardboard stack support drive mechanism A, a pair of cardboard raising mechanisms B, a pair of feed rollers 35 and 36 and a pair of compressed air jetting means C. The cardboard stack support 2 is mounted in a frame 1 for movement relative thereto. The detector 3 is provided on the frame 1 for detecting the front of the cardboard stack on the support 2.

The cardboard stack support drive mechanism A serves to move the cardboard stack support 2 so as to bring the front 4 of the cardboard stack on the support 2 to a reference position according to a signal from the detector 3. The cardboard raising mechanism B is provided in the frame 1 such that it can be brought to the reference position P in contact thereto. The pair of feed rollers 35 and 36 are provided in the frame 1 above the cardboard raising mechanism B. The pair of compressed air jetting means C are provided such that they face the opposite sides of the cardboard stack on the support 2.

The cardboard stack support 2 includes a bottom 2-1, wheels 5 mounted on the underside of the bottom 2-1 and a back plate 2-2 projecting upright from the bottom 2-1. The wheels 5 rest on a pair of rails 6 (only one of the rails being shown in FIG. 1) provided on the frame 1 and movable along the rails 6.

The cardboard stack support drive mechanism A includes a motor 5-4 with speed change gears mounted on the underside of the bottom 2-1, an endless chain 5-3 passed round a sprocket 5-1 provided on an axle of the motor 5-4 and a sprocket 5-2 provided on an axle of wheels 5, and a control circuit (not shown) for operating the motor 5-4 in response to a signal from the cardboard stack front position detector 3. The control circuit serves to bring the front 4 of the cardboard stack on the support 2 to the reference position P according to the signal from the detector 3. It also produces an operating signal for moving the cardboard stack support 2 to the left in FIG. 1 in response to the operation of a switch (not shown) or the like when stacking cardboards. The cardboard stack front position detector 3 consists of a light reflecting type photosensor, and its signal is discontinued when the front 4 of the cardboard stack is brought to the reference position P.

Figure 3:
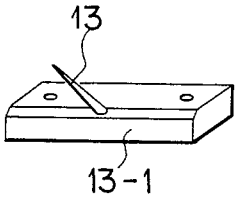
Figure 4:
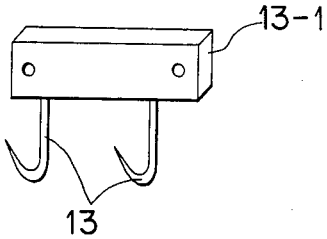

The cardboard raising mechanisms B (only one of them being shown in FIG. 1) include a common shaft 7 rotatably mounted in the frame 1. It extends horizontally and perpendicular to an extending direction of the rails 6, and it carries a sprocket 7-1 secured to it. The sprocket 7-1 is coupled by an endless chain 7-2 to a motor with deceleration gears (not shown) mounted in the frame 1. A pair of arms 8 of the respective cardboard raising mechanisms B are mounted via bearings 7-3 on the shaft 7 and depend from the shaft 7. The shaft 7 has sprockets 9 secured to its opposite end on the outer side of the arms 8. An endless chain 12 is passed round each of the sprockets 9, 10 and 12 and also round sprockets 10 and 11 mounted on shafts 7, 9-1 and 9-2 parallel to the shaft 7. The pair of endless chains 12 have respective hook supports 13-1 and 13-2 provided at like positions. FIGS. 2 through 4 show respective examples of the hook supports 13-1 and 13-2. As is shown, the hook support 13-1 and 13-2 have one or two upwardly directed needle-like hooks 13.

The pair of feed rollers 35 and 36 have respective shafts 14-1 and 14-2 extending parallelly to the cardboard stack on the support 2 via bearings 14 mounted on the frame 1. One of the feed roller shafts, i.e., shaft 14-1, has a drive chain sprocket 15 and a spur gear 16. The other feed roller shaft 14-2 has a driven spur gear 17 in mesh with the gear 16. Drive power for driving the feed rollers 35 is transmitted from a motor with decelaration gears (not shown) to the sprocket 15 via an endless chain 18-2, and the driven spur gear 17 of the feed roller 36 is driven by the drive spur gear 16 of the feed roller 35. The rotational speed of the feed rollers 35 and 36 is set to be higher than the driving speed of the endless chain 12 for driving the cardboard raising mechanisms B.

The pair of compressed air jetting means C (only one of which is shown in FIG. 1) are disposed substantially on the opposite sides of the cardboard raising mechanisms B. Each of the means C includes a shaft 19, a pair of universal joints 20, a shaft 22, an upper air header 23, a compressed air source (not shown), a lower air header 27 and a flexible pipe 30. The shaft 19 is mounted in a mounting member 18-1 secured to the frame 1 and extends parallel to the shafts 14-1 to 14-2 of the feed rollers 35 and 36. The universal joints 20 pivotally depend from the shaft 19. The cylindrical shaft 22 is rotatably fitted in a sleeve-like member coupled to the lower ends of the universal joints 20. The upper air header 23 extends vertically and is pivotally coupled at the upper end to the shaft 22. The compressed air source (not shown) is coupled to an air inlet port 24 of the upper air header 23 via a flexible pipe 25 and an electromagnetic valve (not shown). The lower air header 27 is pivotally coupled to the lower end of the upper air header 23 via a universal joint 26. The flexible pipe 30 communicates with the pipes 28 and 29 of the upper and lower air headers 23 and 27. A plurality of compressed air jet nozzles 31 perpendicularly project from the upper and lower air headers 23 and 27 toward the corresponding edge 33-1 of the front end cardboard in the stack. A plurality of cardboard posture follower rods 32 perpendicularly project from the upper and lower air headers 23 and 27. Said rods have a sufficient length to reach the front surface 4 of the front end cardboard, and each rod has an eccentric roller 34 rotatably mounted on a free end thereof. The electromagnetic valve (not shown) noted above is adapted to cause jetting of compressed air in a synchronous relation to the hooks 13 carried by the endless chains 12 in the cardboard raising mechanisms B.

The operation of the apparatus will now be described.

The cardboard stack support 2, which has been already piled with individual cardboards 33 thereon in an upright state parallel to the stack plate 2-2, is driven to move toward the cardboard raising mechanisms B through the motor 5-4 by operating a switch (not shown) or the like. As a result, the cardboard posture follower rods 32 are pressed and pushed by the front surface 4 of the forwardly advancing cardboard stack, whereby the upper and lower air headers 23 and 27 are brought to a state conforming to the posture of the front 4 of the cardboard stack. When the front 4 of the cardboard stack is brought to the reference position P, a switch is worked by the cardboard stack front position detector 3, thus stopping the cardboard stack support 2. The endless chains 12 are held in a position corresponding to the inclination angle of the front 4 of the cardboard stack owing to a pivotal motion of the arms 8 of the cardboard raising mechanisms B about the shaft 7 caused by the cardboard stack front. When the motor with speed reduction gears (not shown) is subsequently started, the endless chains 12 are driven in the direction of arrow D via the sprocket 7-1, shaft 7 and sprockets 9. The cardboards 33 are thus fed one by one obliquely upwardly by the hooks 13 hooking each cardboard 33. Each cardboard 33 having been raised by the cardboard raising mechanisms B is transferred by the feed rollers 35 and 36 to a succeeding process station (not shown). The cardboard 33 will naturally detach from the hooks 13 because the feed speed of the feed rollers 35 and 36 is higher than the feed speed of the cardboard raising mechanisms B. When the cardboard 33 is fed upward by the mechanisms B, the electromagnetic valve (not shown) is operated in a synchronous relation to the hooks 13 carried by the endless chains 12 causing compressed air to be jet through the compressed air jet nozzles 31 toward the opposite sides 33-1 of the laminar cardboard stack. Air is thus blown into the space between adjacent cardboards in the stack, so that the individual cardboards are separated from one another. As the cardboard is raised, the rollers 34 in contact with the cardboard are rotated to cause rocking of the cardboard posture follower rods 32, upper and lower air headers 23 and 27 and compressed air jet nozzles 31. This has an effect of more reliably separating the individual cardboards. The cardboard stack support 2 is moved according to a signal from the cardboard front position detector 3 such that the front 4 of the cardboard stack is always at the reference position P, at which the front end cardboard can be fed upward by the cardboard raising mechanisms B.

As has been described in the foregoing, according to the invention the individual cardboards in a stack can be reliably separated and supplied one by one by virtue of compressed air blown against the opposite sides of the laminar cardboard stack, and this feature is very beneficial in the industry.

What is claimed is:

1. An apparatus for supplying cardboards comprising:

a frame;

support means for supporting a stack of cardboards and arranged on said frame for horizontal reciprocal movement;

a cardboard stack front position detecting means provided on said frame for detecting a position of the front of the cardboard stack on said cardboard stack support means;

cardboard stack support drive means for moving said cardboard stack support means to bring the front of the stack of cardboards on the cardboard stack support means to a reference position in response to a signal from said cardboard stack front position detecting means;

a pair of cardboard raising means mounted in said frame for contacting the front of the cardboard stack at said reference position;

a pair of rollers in said frame and above said cardboard stack raising means; and a pair of compressed air jet means facing opposite sides of the stack of cardboards on said support means;

each pair including a pair of pivotally arranged bendable members depending from said frame on opposite sides of the stack of cardboards, cardboard posture follower rods projecting from said pivotally arranged bendable members for contacting the front surface of the stack on said support means, and compressed air jet nozzles projecting from said pivotally bendable members.

2. An apparatus according to claim 1, wherein said support means includes a bottom portion, wheels mounted on an underside of said bottom portion, and a back plate projecting upright from the bottom portion for stacking the stack thereagainst.

3. An apparatus according to claim 1, wherein said cardboard stack front position detecting means is a photo sensor.

4. An apparatus according to claim 1, wherein said drive means includes a motor with speed change gears, an endless chain sprocket provided on an axle of said motor, a pair of rails provided on the frame, and control means for operating said motor in response to a signal from said detecting means.

5. An apparatus according to claim 4, wherein said wheels rest on, and are movable along, said pair of rails.

6. An apparatus according to claim 4, wherein said motor is mounted on the underside of said bottom portion.

7. An apparatus according to claim 1, comprising a shaft common to said pair of cardboard raising means, and rotatably mounted in said frame, a sprocket secured to said shaft, an arm, and an endless chain.

8. An apparatus according to claim 7, wherein said endless chain is passed around two sprockets secured to opposite ends of said arm, and also around said sprocket mounted on said shaft.

9. An apparatus according to claim 7, wherein said endless chain has at least one hook support.

10. An apparatus according to claim 9, wherein said hook support has at least one upwardly directed needle-like hook.

11. An apparatus according to claim 1, wherein said pair of feed rollers are arranged parallel to the cardboard stack on said support.

12. An apparatus according to claim 11, wherein one of said rollers has a drive chain sprocket, and a spur gear, and the other feed roller has another spur gear in mesh with said spur gear.

13. An apparatus according to claim 11, comprising means for driving said feed rollers at a rotational speed higher than said raising means.

* * * * *